United States Patent [19]

Fleury

[11] Patent Number: 4,857,412

[45] Date of Patent: Aug. 15, 1989

[54] METHOD FOR FORMING A PLANAR SHEET OR PLATE TO A CURVED SHAPE

[76] Inventor: Paul Fleury, 74, Chemin Lemieux,, St-Vallier-de-Bellechasse, Quebec, Canada, G0R 4J0

[21] Appl. No.: 3,155

[22] Filed: Jan. 14, 1987

[30] Foreign Application Priority Data

Jan. 16, 1986 [CA] Canada ..... 499743

[51] Int. Cl.[4] ..... B21C 1/00; B21C 27/00; B21H 3/00; B21B 19/14

[52] U.S. Cl. ..... 428/577; 29/423; 29/155 R; 72/167; 72/168; 72/214; 72/377; 72/379; 428/579; 428/600

[58] Field of Search ..... 29/509, 423; 72/180, 72/182, 379, 73, 74, 133, 142, 220, 221, 222, 124, 214, 133, 406, 168, 163, 167, 234, 377; 428/577, 571, 573, 600

[56] References Cited

U.S. PATENT DOCUMENTS

| | | | |
|---|---|---|---|
| 341,020 | 5/1886 | Kent | 72/124 X |
| 926,523 | 6/1909 | Wandersleb . | |
| 1,032,907 | 7/1912 | Hyde . | |
| 1,244,422 | 10/1917 | Carter | 72/74 |
| 1,461,853 | 7/1923 | Kennedy | 72/74 |
| 1,941,484 | 1/1934 | Nasmith | 72/234 X |
| 2,059,292 | 11/1936 | Taylor | 72/379 |
| 2,095,533 | 10/1937 | Schmidt | 72/379 |
| 2,169,025 | 8/1939 | Forbes | 72/379 X |
| 2,183,969 | 12/1939 | McKinney | 72/180 X |
| 2,246,578 | 6/1941 | De Salardi | 29/155 R X |
| 2,443,170 | 6/1948 | Smith | 29/155 R U X |
| 2,488,510 | 11/1949 | Lewin | 428/600 |
| 2,674,294 | 4/1954 | Ekberg . | |
| 2,674,494 | 4/1954 | Matteson et al. | 290/121 |
| 2,695,329 | 11/1954 | Sabine | 428/573 |
| 3,204,372 | 9/1965 | Richter | 72/379 X |
| 3,376,726 | 4/1968 | Rauyer et al. | 72/379 |
| 3,392,566 | 7/1968 | Sparck | 72/220 |
| 3,490,405 | 1/1970 | Reader et al. . | |
| 3,566,661 | 3/1971 | McCafferty et al. | 72/365 |
| 3,792,602 | 2/1974 | Fukuda | 72/220 |
| 4,241,146 | 12/1980 | Sivachenko et al. | 428/577 X |
| 4,305,271 | 12/1981 | Whatley | 72/220 |
| 4,736,607 | 4/1988 | Wochnik | 72/124 X |

FOREIGN PATENT DOCUMENTS

| | | | |
|---|---|---|---|
| 1334589 | 10/1973 | United Kingdom | 72/124 |

*Primary Examiner*—Charlie T. Moon
*Attorney, Agent, or Firm*—Joseph G. Seeber

[57] ABSTRACT

The present disclosure relates to an apparatus and a method for deforming sheet metal plates and more particularly aluminium and steel plates. The objectives of this disclosure are realized by laminating a plate of sheet metal in juxtaposed and parallel strips. This method allows for the formation of spherical surfaces having a variable curvature. These strips are oriented according to predetermined axes according to the expected result.

8 Claims, 4 Drawing Sheets

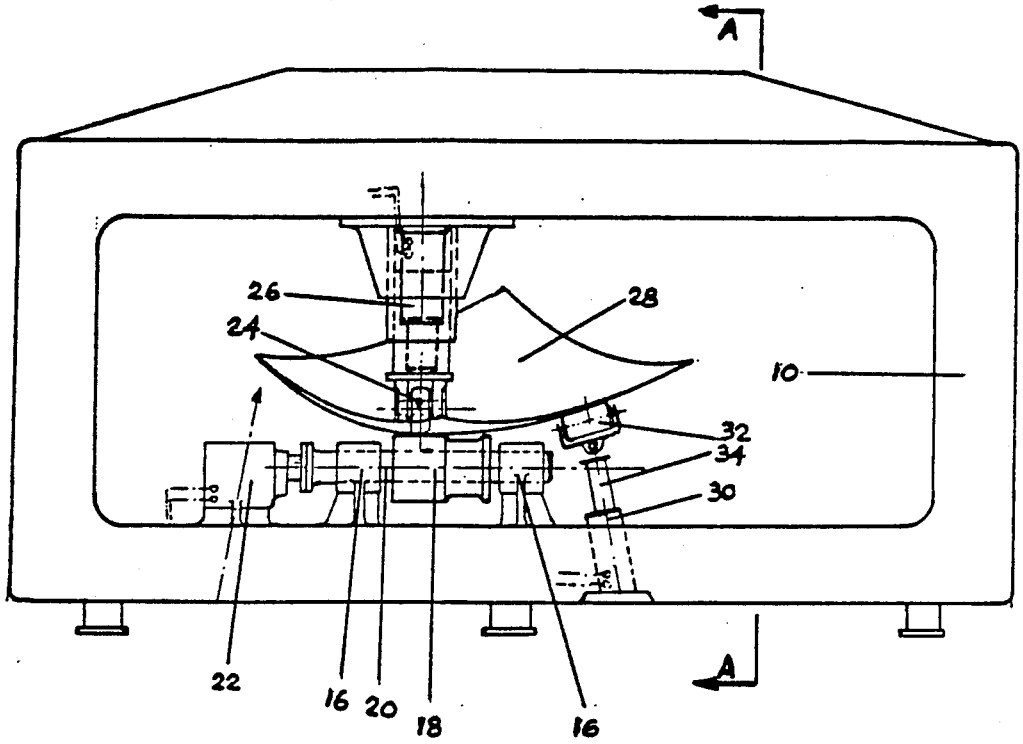
FIGURE 1
FIGURE 2
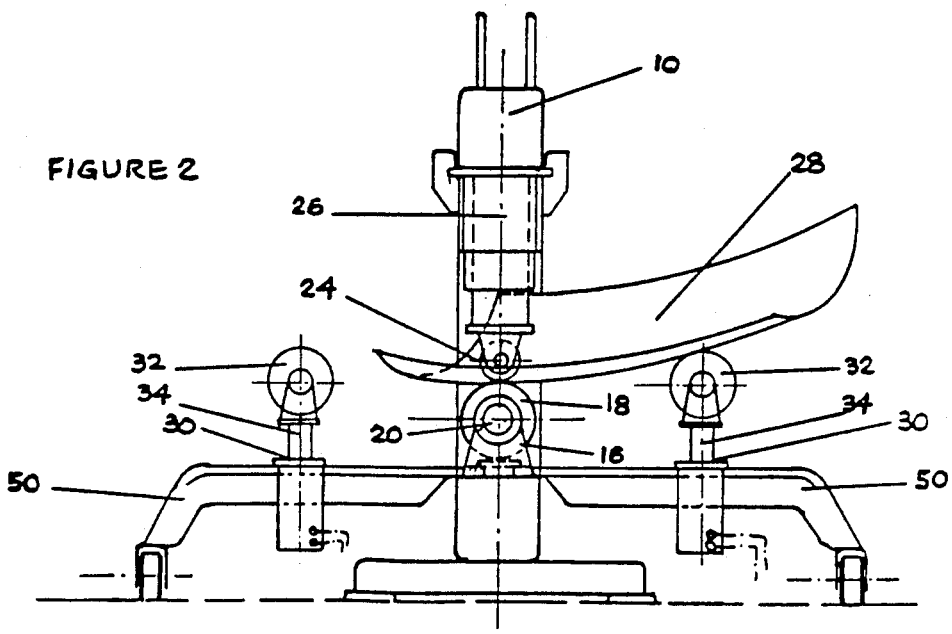

METHOD FOR FORMING A PLANAR SHEET OR PLATE TO A CURVED SHAPE

The present invention relates to an apparatus and a method for deforming metal sheets or plates and more particularly aluminium and steel plates. This method allows the formation of spherical surfaces or surfaces having a variable curvature.

DESCRIPTION OF THE PRIOR ART

Among the methods for plastic forming of metal, we find forging with open or closed matrixes, lamination and embossing.

The matrix forging and embossing allow the production of spherical shapes or those having a variable curvature. However, they require the use of moulds or dies which increase the operation costs and inapplicable to the production of small quantities. Lamination is used especially for the fabrication of structural profiles, rails, metal sheets and plates.

The traditional lamination process consists in the formation of the piece of metal between two cylinders which rotate in opposite directions and exert a compression force on the said piece. Such lamintaion may be carried out in a cold or a holt environment. That lamination is reserved for large sections such as structural profiles, rails and thick plates, while the cold lamination is reserved for thin plates and sheets. It is also possible to laminate complex structural profiles by using grooved cylinders.

To achive cylindrical or spherical shapes, some inventions have already provided interesting folding processes. For example, U.S. Pat. Nos. 926,523, 1,032,907 and 4,305,271 illustrate different tools using this method which is basically a technique based on elastic support. It is possible to perform spherical and cylindrical shapes with this method, but it is essentially a sophisticated folding technique. Another method to obtain complex shapes is described in U.S. Pat. No. 3,490,405. The method shown is such that it is essentially a matrix technique and requies the application of heat. This method applies essentially to mass production. Two other techniques are proposed in the U.S. Pat. Nos. 2,674,294 and 3,566,661. Those techniques use rollers or wheels, which could resemble the one proposed herein. However, in U.S. Pat. No. 2,674,494, we find that only the conical or cylindrical shapes can be obtained whereas U.S. Pat. No. 3,566,661 suggests essentially a technique wherein linear embossing is used, for example, in making gutters.

There is no manufacturing process or apparatus which gives complex shape to a metal sheet using the laminating technique and which meets the following requirements.

BRIEF DESCRIPTION OF THE INVENTION

The first object of the present invention is to provide a manufacturing process as well as an apparatus for forming metal sheets having spherical shapes and/or shapes having variable curvatures.

A second object is to use a laminating process allowing a good finish compared to the hammering process. As used below, the terms "laminate", "lamination" and "laminating" are intended to refer to a process of squeezing a single sheet of metal between a roller and a wheel to produce lamination strips and weakened portions, thus facilitating subsequent folding of the metal.

A third object is to provide to the sheet metal industry a tool with a very low noise level.

A fourth object is to provide an apparatus and method which also permits folding.

To meet those requirements our apparatus is equipped with, instead of the two standard cylinders used in the laminating process, one cylinder and one wheel to laminate only a section or strip of the plate or sheet at a time, such section or strip corresponding to the wheel's width.

By laminating many similar closely spaced parallel strips a first laminating stroke is created which is oriented along a privileged axis.

In order to prevent the rapid decrease of the thickness of the metal sheet and the loss of control of the deformation, each stroke reduces the thickness of metal sheet by a small increment until the final result is obtained. Therefore, many strokes are necessary to obtain the final result.

Furthermore, it is necessary to change the direction of the axis after each stroke, in order to allow the sheet of progressively take form. The alternation of axis must be made between two transversal axes relative to each other.

All these procedures define a lamination pattern.

In addition, to obtain the right shape, a non laminated border frame must be kept on the perimeter of the metal sheet. The border frame limits the deformation from the sheet's or plate's original plane, thus forcing concave deformation. Once the desired shape is obtained, it is possible to cut or remove the said frame.

If necessary, according to the degree of deformation required, it is possible to perform a stress relieving step between two strokes to facilate the subsequent strokes.

By controlling the lamination pattern, it is possible to form a plate into a shape having a variable curvature.

DESCRIPTION OF THE DRAWINGS

These and other objects of the invention will be apparent from the description which follows and from the drawings wherein like numerals are used throughout to identify like parts:

FIG. 1: is a perspective view of apparatus according to the invention;

FIG. 2: is a cross-sectional view thereof taken along line A—A;

DESCRIPTION OF PREFERRED EMBODIMENTS

Figure 4:
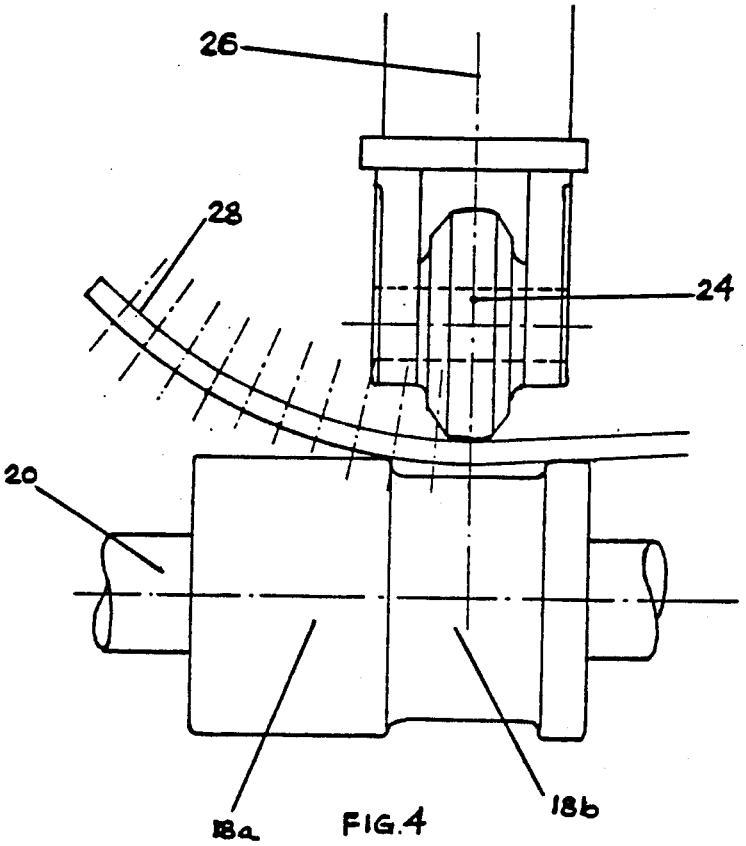
FIG. 4: is an enlarged view of the wheel and the cylinder shown in FIG. 3.
Figure 3:
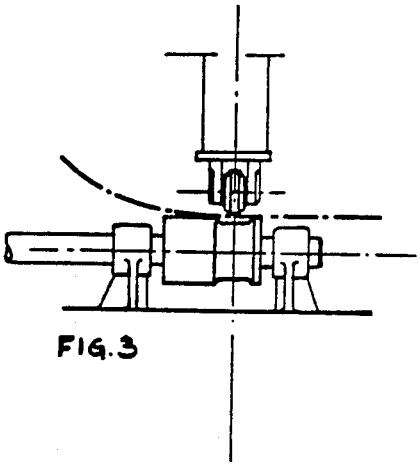
FIG. 3: shows the wheel and the cylinder shown in FIG. 1 in bending position.

Referring now to the drawings, there is shown a wheel 24 and a cylinder 18. The wheel 24 is supported by an hydraulic system 26 which allows the raising or the lowering of the wheel and the application of the necessary force for laminating the metal sheet or plate 28.

The cylinder 18 is supported by the shaft 20. Both pieces are then supported by the trust bearing 16. A motor 22 drives the system by way of one of the extremities of the shaft 20.

A frame 10 holds all the pieces together to balance the forces.

Figure 5:
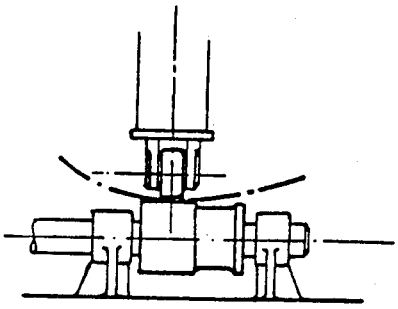
FIG. 5: illustrates the wheel and the cylinder in the lamination position.

The said cylinder 18 is also provided, as seen from FIG. 4, with a grooved portion 18*b*. Consequently, the lamination is carried out when the wheel 24 is above the portion 18*a*, as seen from FIG. 5, whereas the grooved portion 18*b*, illustrated in FIG. 4, is used to realize micro folding which, after many strokes, results in the formation of an half cylinder or gutter.

Firstly, two supports 30 consisting in rollers 32 and hydraulic cylinders 34 provide, a resting point which illustrates overhang or encasement effects at the point where the plate or sheet is laminated.

The said rollers 32 will be gradually raised to maintain the contact between the roller and the plate during forming by way of the hydraulic cylinders 34 which are connected to a servo control which is not illustrated but is well known to those skilled in the art.

Secondly, the said rollers 32, as well as the hydraulic cylinders 34, will be connected to a second servo control, which is also known, which allows a rotation of the plate or sheet during processing.

It is also possible to (optionally) improve the quality of the work by pivoting the wheel 24 by more or less 6 degrees relative to its axis.

In FIGS. 6*a* to 6*d* and 7, two strips lamination patterns as well as their construction are illustrated.

Figure 6A:
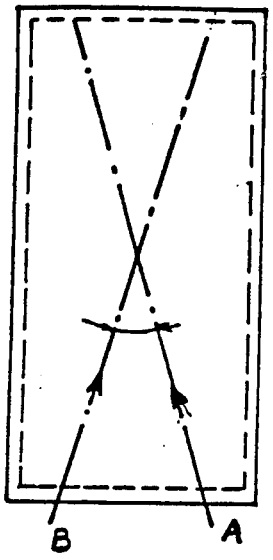
FIGS. 6*a* to 6*d*: illustrate a rectangular plate with an example of lamination pattern as well as the various stages of same.

To start with the strip lamination process we have to choose two axes A and B as illustrated in FIG. 6*a* as well as the angle D between those two axes. In addition, it should be noted that the origin C of the two axes does not necessarly have to be in the center of the plate, that the two axes do not have to be symmetric, and that they do not have to reach the corners of the plate or sheet.

The choice of all those variables varies as a function of the expected result. There is not exact rule to determine those variables. However, it has been found that when A and B are crossed, the angles between the axes must be between 10° and 90°.

When those preliminary choices are made, the lamination can be performed. First, we have to laminate along one of the two chosen axes. Then, a series of adjacent and parallel strips are laminated from the initial strip to one corner of the sheet extending laterally from said strip.

Figure 6B:
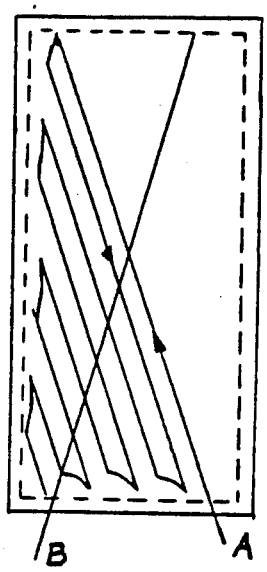

We thus obtain the results hown in FIG. 6*b*. Then, we complete with the same procedure for the second unlaminated portion of the plate.

This completes the first lamination stroke.

Figure 6C:
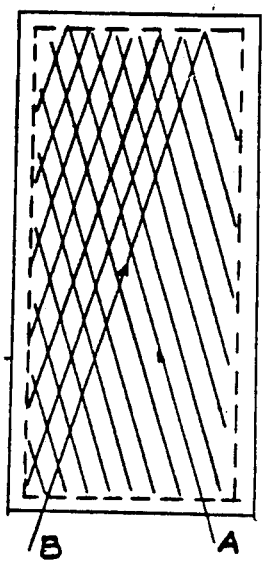
Figure 6D:
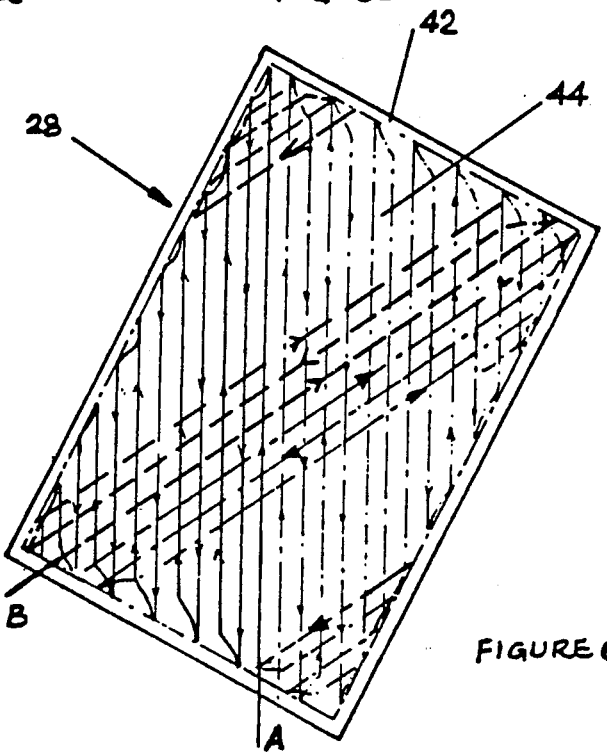

We complete, as shown in FIGS. 6*c* and 6*d*, the second lamination stroke, the same way we did it for the first one, by using axis B instead of axis A as the reference axis.

This procedure is repeated until the desired curvature is obtained. For example, to give a curvature radius of 3 feet to a plate having a thickness of ⅜ of an inch and measuring 28 inches by 40 inches, 4 lamination strokes were necessary.

If necessary, a thremal quenching treatment can be performed between the lamination strokes to relieve the stress in the metal and to allow a greater deformation.

Furthermore, it should be noted that the beginning of each strip must be located inside of the border frame 42. The said border frame is necessary to maintain the original peripheral shape of the plate, that is, to avoid the deformation in the plate border frame plane. The border frame has a variable width which is a function of the dimension and the nature of the plate or sheet used and must extend around a substantial portion of the perimeter of the laminated portion 44 of the plate. For example, for a plate having a thickness of ⅜ of an inch, the border frame on the perimeter has a width of approximately 1½ inches and, for a plate having a thickness of 1 inch, the border frame has a maximum width of 2 inches.

Figure 7:
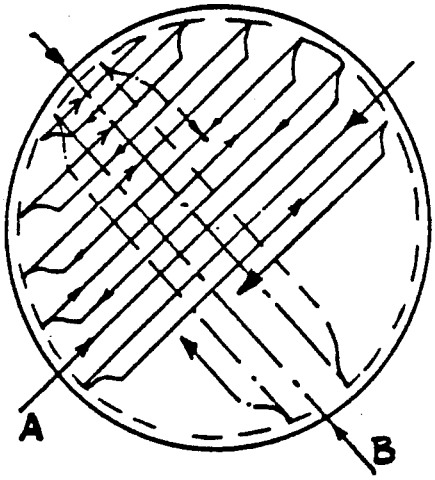
FIG. 7: illustrates a cylindrical plate with a suggested lamination pattern.

FIG. 7 illustrates the pattern to use for the particular case in which a parabola is to be obtained from a sheet metal or plate. We can see that the origin of the axes is in the center of the plate and the angle between the axes is 90°.

Then, we can proceed with the strokes along axes A and B which was described earlier. It might be necessary to make a plurality of strokes to obtain the desired depth.

In the example we have just presented, the plate was entirely laminated. However, it will be understood that the method described can be applied to a part of the plate without departing from the spirit of the invention or the scope of the subjoined claims.

I claim:

1. A method for forming a portion of a planar metal sheet or plate to a curved shape, comprising the steps of:

providing at least one rotating cylinder and a wheel; and compressing to plastically deform said metal sheet or plate along juxtaposed strips between said at least one rotating cylinder placed on one side of said metal sheet or plate and said wheel placed on the other side of said metal sheet or plate so as to create a first compression stroke that develops a plurality of plastically deformed strips therein to form said sheet or plate to the curved shape;

said compression being completed so as to keep an undeformed border frame or variable width on a perphery of said portion to maintain the original peripheral shape of the sheet or plate.

2. The method of claim 1, wherein the juxtaposed strips of the first compression stroke are oriented along a first predetermined axis.

3. The method of claim 2, comprising the further step of compressing to plastically deform further juxtaposed strips so as to create a second compression stroke.

4. The method of claim 3, wherein the juxtaposed strips of the second compression stroke are oriented along a second predetermined axis which is transverse to the first predetermined axis.

5. The method of claim 4, wherein a border frame is maintained on the entire periphery of said portion.

6. The method of claim 3, wherein a border frame is maintained on the entire periphery of said portion.

7. The method of claim 2, wherein a contour is maintained on the entire periphery of the compressed portion.

8. A product obtained by using the method described in any one of claim 1, 2, 3, 4, 5, 6 or 7.

* * * * *